United States Patent [19]

Suster et al.

[11] Patent Number: 4,990,820

[45] Date of Patent: Feb. 5, 1991

[54] CORROSION RESISTANT SOCKETS FOR ELECTRIC LAMPS

[75] Inventors: Albert L. Suster, Chagrin Falls; Rolf S. Bergman, Cleveland Heights, both of Ohio

[73] Assignee: General Electric Company, Schenectady, N.Y.

[21] Appl. No.: 447,296

[22] Filed: Dec. 7, 1989

Related U.S. Application Data

[63] Continuation-in-part of Ser. No. 164,145, Mar. 4, 1988, Pat. No. 4,914,345.

[51] Int. Cl.[5] ..... H01J 5/54

[52] U.S. Cl. ..... 313/49; 313/51; 313/318; 420/469; 420/481; 420/485; 439/615; 439/616; 439/617

[58] Field of Search ..... 313/49, 51, 318; 439/611, 615, 616, 617; 420/481, 469, 485, 498

[56] References Cited

U.S. PATENT DOCUMENTS

| | | | |
|---|---|---|---|
| 2,034,561 | 3/1936 | Davis | 420/498 |
| 2,774,050 | 12/1956 | Logan | 339/75 |
| 3,217,116 | 11/1965 | Martin et al. | 200/51.03 |
| 3,775,634 | 11/1973 | Hassell et al. | 313/318 |
| 4,044,277 | 8/1977 | Komyati | 313/318 |
| 4,456,857 | 6/1984 | Orr et al. | 315/360 |
| 4,496,874 | 1/1985 | Sanders et al. | 313/318 |
| 4,586,967 | 5/1986 | Shapiro et al. | 148/31.5 |
| 4,610,498 | 9/1986 | Thomas | 362/295 |

OTHER PUBLICATIONS

GE Lamp catalog, 1984; p. 3, Technical Data for Incandescent and Quartzline ® Lamps.

*Primary Examiner*—Donald J. Yusko
*Assistant Examiner*—Michael Horabik
*Attorney, Agent, or Firm*—Edward M. Corcoran; Stanley C. Corwin; Fred Jacob

[57] ABSTRACT

Sockets for receiving metal lamp bases of electric lamps which contain metal parts fabricated from certain relatively high copper and low zinc content copper alloys are resistant to corrosion and to corrosion cracking in corrosive environments.

12 Claims, 2 Drawing Sheets

Fig. 2(a)
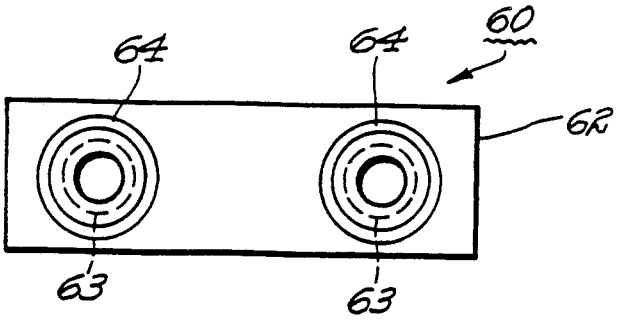
Fig. 2(b)
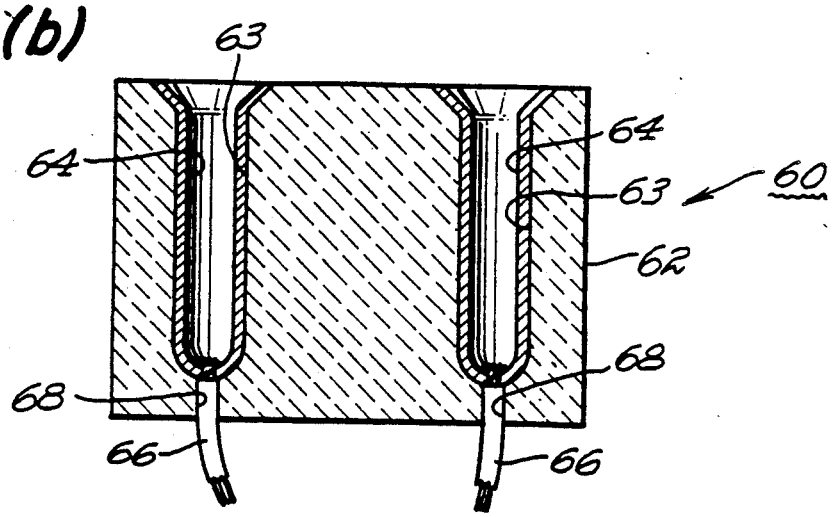
Fig. 3(a)
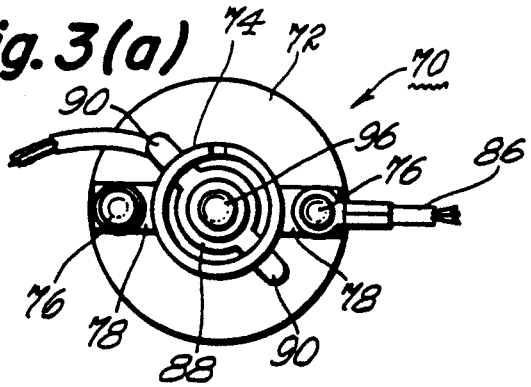
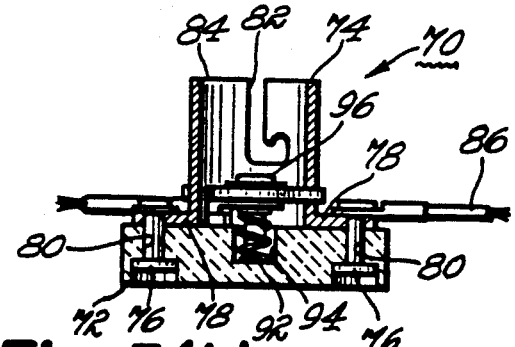
Fig. 3(b)
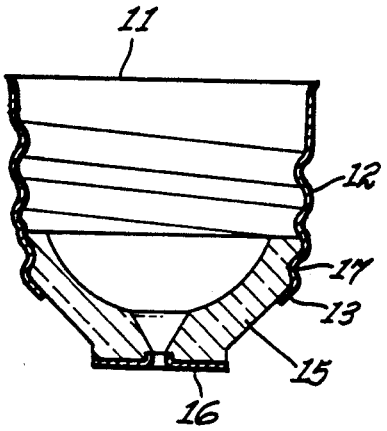
Fig. 4

CORROSION RESISTANT SOCKETS FOR ELECTRIC LAMPS

CROSS-REFERENCE TO RELATED APPLICATION

This application is a continuation-in-part application of copending U.S. Ser. No. 164,145 filed on Mar. 4, 1988 now U.S. Pat. No. 4,914,345, titled Corrosion Resistant Base for Electric Lamps.

BACKGROUND OF THE INVENTION

1. Field of the Invention

This invention relates to sockets for electric lamps having copper alloy metal parts resistant to cracking in corrosive environments. More particularly, this invention relates to sockets for electric lamps wherein the metal parts which make electrical contact with the corresponding metal portions of the lamp base are resistant to corrosion and to cracking in corrosive environments and are made of copper alloy containing at least about 60 wt. % of Cu and less than 10 wt. % Zn, if Zn is present.

2. Background of the Disclosure

Electric lamps invariably have a metal base or cap which is screwed, plugged, or otherwise inserted into a socket for providing current to the lamp. The lamp base or cap is at least partly metal and has an insulating portion to avoid electrical short circuits when inserted into a suitable socket wherein the metal portions of the base make electrical contact with corresponding metal portions of the socket. Such electric lamps include the well known bulb-shaped incandescent lamps, cylindrically shaped lamps, automobile or PAR lamps and various arc discharge lamps. Illustrative, but non-limiting examples of various types of metal bases employed with such lamps may be found in U.S. Pat. Nos. 3,775,634; 4,020,382; 4,044,277 and 4,496,874 and in the catalogs of lamp manufacturers. More often than not, lamps currently manufactured have metal screw bases of standardized sizes for screwing into receptacles for supplying current to the light source. Corresponding receptacles or sockets, including adapters, are known and many examples may be found in the literature and catalogs of manufacturers of such devices. U.S. Pat. Nos. 4,456,857 and 4,610,498 and U.S. Ser. No. 331,554 filed on Mar. 31, 1989 now U.S. Pat. No. 4,928,032 illustrate recent improvements in such devices.

Although various metals such as aluminum, zinc plated steel, brass plated steel, nickel plated steel and certain copper alloys have been suggested for use as lamp bases and for the metal portions of the corresponding sockets, relatively high zinc content copper alloys or brasses containing at least about 10% zinc have invariably been used for the manufacture of such lamp bases. These materials possess a combination of properties, including cost, electrical and thermal conductivity, formability, resistance to mechanical damage, etc., which make them desirable for use in electric lamp bases. One particular copper alloy that has been widely used is a cartridge type of brass known as a C260 alloy which is nominally 70% copper and 30% zinc on a weight basis, with less than 1% of other alloying ingredients. Another brass alloy that has been used is a low brass C240 alloy which nominally contains 80% copper and 20% zinc. U.S. Pat. No. 4,496,874 discloses suitable copper alloys as including, on a weight basis, 45–67% copper, 12–45% zinc and 10–26% nickel, along with the possible addition of minor amounts of various other alloying ingredients.

One of the problems encountered in the lamp industry is the cracking and corroding of such metal lamp bases and sockets in service. Such cracking is exhibited as cracks both parallel to and transverse to the longitudinal axis of the metal base or socket. Such cracking and corrosion sometimes leads to lamp failure and/or difficulty in removing the lamp from the lamp socket. This also represents a potential safety hazard to a user/installer. If a base breaks off in a socket, the power to the socket must be turned off before the broken base part can be removed and a new lamp installed. Similarly, if the metal portion of the socket which mates with the metal portion of the lamp base cracks or corrodes, the socket must also be replaced. Various platings over the brass, such as nickel, zinc and copper have been tried and sometimes have resulted in a small increase in the life of the metal in such environments, but the results have not been satisfactory.

Consequently, a need exists for lamp sockets the metal parts of which are resistant to natural and man-made corrosive environments and which do not exhibit cracks in service.

SUMMARY OF THE INVENTION

The present invention relates to lamp sockets wherein the metal portions of which make electrical contact with corresponding metal portions of a lamp base are fabricated from copper alloys resistant to corrosion and to cracking in corrosive environments. In one embodiment those metal portions of the lamp socket will be fabricated from a high copper content copper alloy comprising copper in an amount of at least about 94 wt. % along with at least one other metal selected from the group consisting essentially of Cd, Zn, Fe, P, Zr, Sn, Co, Si, Al, Cr and mixture thereof. Preferably the metal portions of the lamp socket in this embodiment will be fabricated from a high copper content copper alloy containing at least about 96 wt. % Cu along with at least two other metals selected from the group consisting essentially of Fe, P, Sn and mixture thereof. In another embodiment those metal portions of the lamp socket will be fabricated from a relatively high nickel content copper alloy containing at least about 60 wt. % Cu and at least about 8 wt. % Ni and, optionally, Zn in an amount of less than about 10 wt. %. Preferably these metal portions of the lamp socket in this embodiment will be fabricated from a relatively high nickel content copper alloy containing at least about 85 wt. % Cu, at least about 8.5 wt. % Ni and a metal selected from the group consisting essentially of Fe and Sn present in said alloy in an amount less than about 3 wt. %.

Thus, the present invention also relates to a socket for receiving an electric lamp which socket comprises a housing of electrically insulative material containing at least one cavity for receiving a metal base portion of said lamp and said cavity having a metal portion such as a sleeve or strip within which makes electrical contact with a corresponding metal portion of said lamp base, wherein in one embodiment said metal in said socket is fabricated from a high copper content copper alloy containing at least about 94 wt. % Cu along with at least one other metal selected from the group consisting essentially of Cd, Zn, Fe, P, Zr, Sn, Co, Si, Al, Cr and mixture thereof, and preferably, fabricated from a high copper content copper alloy containing at least about 96 wt. % Cu along with at least two other metals selected from the group consisting essentially of Fe, P, Sn and mixture thereof. In another embodiment, the metal in the socket will be fabricated from a relatively high nickel content copper alloy containing at least about 60 wt. % Cu and at least about 8 wt. % Ni and, optionally, Zn in an amount of less than about 10 wt. %. Preferably in this embodiment, the metal will be fabricated from a relatively high nickel content copper alloy containing at least about 85 wt. % Cu, at least about 8.5 wt. % Ni and a metal selected from the group consisting essentially of Fe and Sn present in said alloy in an amount less than about 3 wt. %.

BRIEF DESCRIPTION OF THE DRAWINGS

FIG. 2 is a schematic illustration of a socket for receiving a pin type lamp base.

FIG. 3 schematically illustrates a socket for receiving a bayonet type metal lamp base.

FIG. 4 is a cross-sectional illustration of a conventional metal screw base for an electric lamp useful with a socket of the present invention.

DETAILED DESCRIPTION

Figure 1A:
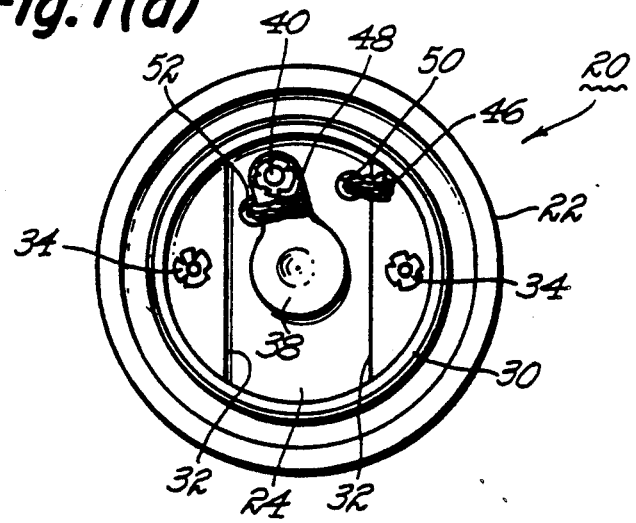
FIG. 1 is a schematic illustration of a socket for receiving a conventional metal lamp screw base.

As set forth above, the present invention relates to a socket for an electric lamp which socket comprises a housing of electrically insulative material containing at least one cavity for receiving a metal base portion of said lamp, wherein said cavity has a metal portion within which makes electrical contact with a corresponding metal portion of said lamp base and said metal portion of said socket is fabricated from a copper alloy resistant to cracking and corrosion in corrosive environments. In one embodiment the metal will be fabricated from a high copper content copper alloy containing at least about 94 wt. % Cu along with at least one other metal selected from the group consisting essentially of Cd, Zn, Fe, P, Zr, Sn, Co, Si, Al, Cr and mixture thereof. Preferably the metal in this embodiment will be fabricated from a high copper content copper alloy containing at least about 96 wt. % Cu along with at least two other metals selected from the group consisting essentially of Fe, P, Sn and mixture thereof. One particularly preferred high copper content copper alloy consists essentially of Cu and Cd with the aggregate amount of Cu and Cd present in an amount at least about 99.90 wt. % and with the amount of Cd present ranging between about 0.05–0.30 wt. %. Another particularly preferred high copper content copper alloy contains at least about 97.0 wt. % Cu along with Zn, Fe and P wherein the amount of Zn, Fe and P present in said alloy ranges between about 0.05–2.0 wt. %, 2.1–2.4 wt. % and 0.015–0.15 wt. %, respectively. This alloy can also contain Pb in an amount not exceeding about 0.03 wt. %.

In another embodiment the metal electrical contact portion of the socket which contacts the corresponding metal portion of the lamp base will be fabricated from a relatively high nickel content copper alloy containing at least about 60 wt. % Cu and at least about 8 wt. % Ni and, optionally, Zn in an amount of less than about 10 wt. %. Preferably the metal in this embodiment will be fabricated from a relatively high nickel content copper alloy containing at least about 85 wt. % Cu, at least about 8.5 wt. % Ni and a metal selected from the group consisting essentially of Fe and Sn present in said alloy in an amount less than about 3 wt. %. In a particularly preferred socket according to this embodiment the metal electrical contacting portion will be fabricated from a relatively high nickel content copper alloy containing at least about 85 wt. % Cu, at least about 9.0 wt. % Ni and also Fe in an amount ranging between about 1.0–1.5 wt. %. One commercially available alloy suitable for use in the practice of this invention is known as C706 which has a nominal composition comprising 89 wt. % Cu, 10 wt. % Ni and 1.4 wt. % Fe. Such high nickel alloys can also contain, on an optional basis, one or more additional alloying metals selected from the group consisting essentially of Pb, Zn, Mn and mixture thereof with the aggregate amount of these three metals present in the alloy not exceeding about 2.5 wt. %.

Thus, an electric lamp socket according to the present invention will comprise a housing made of electrically insulative material containing at least one cavity for receiving a metal base portion of a lamp with said cavity having a metal portion within which makes electrical contact with a corresponding metal portion of a lamp base, wherein in one embodiment said metal portion of said socket is fabricated from a high copper content copper alloy containing at least about 94 wt. % Cu along with at least one other metal selected from the group consisting essentially of Cd, Zn, Fe, P, Zr, Sn, Co, Si, Al, Cr and mixture thereof, and preferably fabricated from a high copper content copper alloy containing at least about 96 wt. % Cu along with at least two other metals selected from the group consisting essentially of Fe, P, Sn and mixture thereof. A particularly preferred metal for a lamp socket according to this embodiment will be a high copper content copper alloy which consists essentially of Cu and Cd with the aggregate amount of Cu and Cd present in an amount of at least about 99.90 wt. % and with the amount of Cd present ranging between about 0.05–0.30 wt. %. Another particularly preferred high copper content copper alloy for the electrically conductive and contacting metal portion of a socket according to this embodiment will contain at least about 97.0 wt. % Cu along with Zn, Fe and P wherein the amount of Zn, Fe and P present in said alloy ranges between about 0.05–0.20 wt. %, 2.1–2.4 wt. % and 0.015–0.15 wt. %, respectively. This alloy can also contain Pb in an amount of exceeding about 0.03 wt. %.

In another embodiment the electrical contacting metal portion of a socket according to this invention will be fabricated from a relatively high nickel content copper alloy containing at least about 60 wt. % Cu and at least about 8 wt. % Ni and, optionally, Zn in an amount of less than about 10 wt. %. Preferably the metal will be fabricated from a relatively high nickel content copper alloy containing at least about 85 wt. % Cu, at least about 8.5 wt. % Ni and a metal selected from the group consisting essentially of Fe and Sn present in said alloy in an amount less than about 3 wt. %. A particularly preferred metal according to this embodiment will contain a metal base fabricated from a relatively high nickel content copper alloy containing at least about 85 wt. % Cu, at least about 9.0 wt. % Ni and Fe in an amount ranging between about 1.0–1.5 wt. %. Such alloys can also contain, on an optional basis, one or more additional alloying metals selected from the group consisting essentially of Pb, Zn, Mn and mixture thereof with the aggregate amount of these three metals present in the alloy not exceeding about 2.5 wt. %. As set forth above, a commercially available alloy meeting these compositional requirements is designated a C706 alloy.

It has been found that metal lamp bases and the metal portions of lamp sockets which make electrical contact with the corresponding metal portions of lamp bases invariably contain residual or internal stresses as a result of the forming process and, in the case of copper alloys, such stresses sometimes result in failure of the material either in storage or in service through stress-corrosion cracking. Even if stress relieved, stresses are reintroduced by installing a lamp in a socket. One of the primary corrosive agents has been found to be ammonia in combination with humid environments. Copper alloys such as high zinc content cartridge brasses are sensitive to stress corrosion cracking, even in the presence of relatively minor amounts of ammonia. This stress-corrosion cracking exhibits itself as cracks either more or less parallel to or transverse to the longitudinal axis of the socket or base, which leads to lamp failure an/or difficulty in removing the lamp from a socket. Although it is theoretically possible to stress relieve such metal parts before they are assembled onto or into a lamp envelope or lamp socket, this is often not practicable. Accordingly, lamp sockets the metal portions of which make electrical contact with corresponding metal portions of lamp bases fabricated from metal according to the present invention will have relatively high resistance to corrosion and to stress-corrosion cracking.

Figure 1B:
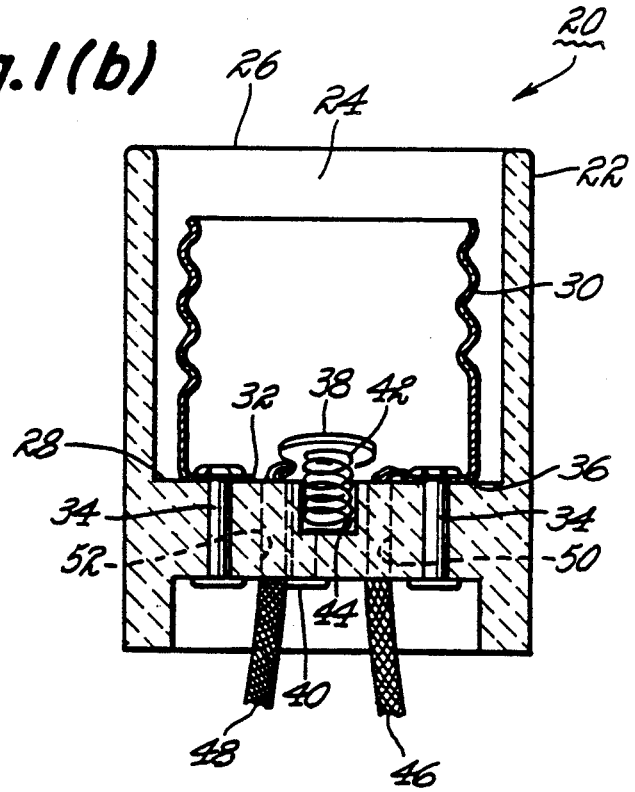

FIG. 1 schematically illustrates a representative socket for a lamp having a screw type metal base commonly used for electric lamps. Thus, socket 20 comprises cylindrical housing 22 made of an electrically insulating material containing a cavity 24 within open at one end 26 and closed at the other end 28. Cavity 24 contains a screw threaded metal shell 30 within, held in place by bent metal tabs 32 secured by means of rivets 34 through closed end portion 36. Bent metal contact 38 is fastened to closed end wall 36 by rivet 40. Spring 42 in cavity 44 exerts an upward, resilient force on contact 38. Insulated wire conductors 46 and 48 are electrically connected to shell 30 and contact 38, respectively, and pass through wall 36 by means of holes 50 and 52, respectively. Metal shell 30 and preferably also contact 38 are made of a copper metal alloy according to the invention. Cylindrical housing 22 is made of a plastic, glass or ceramic material, depending on the size and wattage of the lamp. For ordinary residential incandescent lamps a heat resistant plastic will often suffice For larger lamps and higher wattage lamps housing 22 is generally made of a ceramic material.

FIG. 2 is a simplified schematic illustration of a socket for a double pin or bipost type of lamp base and is well known to those skilled in the art. Thus socket 60 comprises rectangular shaped housing 62 made of electrically insulating material which contains metal cups 64 cemented into cavities 63. Electrically conductive wires 66 are electrically connected to cups 64 and pass through holes 68 of housing 62. Housing 62 is generally made of a ceramic material. In some cases it can be made of a plastic material, depending on the size and wattage of lamp retained in the socket. Metal cups 64 are made of a copper alloy according to the invention.

FIG. 3 schematically illustrates a bayonet type of lamp socket 70 which comprises disk shaped housing 72 made of electrically insulating material on which is mounted metal shell 74 by means of rivets 76 through legs 78 and holes 80 of housing 72. Metal shell 74 is fabricated from a copper alloy according to this invention and contains a pair of diametrically opposed T-shaped slots 82 therein extending downward from open end 84 for insertion of the locking members of a bayonet type lamp base (not shown). Conductive wire 86 is electrically connected to one of the tabs or legs 78. Disk 88, also made of electrically insulating material, is contained within the bottom of shell 74 by means of tabs 90 which project through slots (not shown) in the bottom of shell 74. Spring 92, one end of which is seated in cavity 94 exerts an upward pressure on disk 88. Electrical contact 96 is riveted through disk 88 to which insulated conductor 96 is electrically connected. Shell 74 and preferably also contact 96 are made of a copper alloy according to the invention.

FIG. 4 represents a typical construction of a screw type metal base commonly used for electric lamps. Referring to FIG. 4, metal base shell 11, fabrication from a copper alloy according to the present invention, has a threaded portion 12 and a flange end portion 13 which is turned or rolled inwardly to provide a reduced diameter opening for receiving insulator 15. Insulator 15 is formed from any suitable non-conductive material such as ceramic, glass, or plastic. The insulator is molded or shaped by any suitable means known in the art to produce a button-like article having one or more apertures depending upon the number of filaments in the lamp, and having a cylindrical portion merged with a conical portion terminated in a plateau for receiving one or more conductive metal contacts, such as metal contact 16. Metal contact 16 may be fabricated from a copper alloy according to the present invention and comprises a disc having a hole for receiving one of the leads from a filament (in the case of an incandescent lamp) or an arc tube electrode (in the case of an arc discharge lamp) which may then be soldered or welded thereto. Contact 16 may be conveniently attached to insulator 15 by flaring the hole therein to engage the corresponding hole in insulator 15. The cylindrical portion of insulator 15 contains an annular groove or undercut 17. While illustrated in FIG. 4 as having a semicircular cross section, undercut 17 may have any suitable cross section, depending upon how insulator 15 is to be attached to shell 11.

In fabricating such bases, conductive contact 16 is attached to insulator 15 by any suitable means, such as described above. Insulator 15 is then inserted into shell 11 so that the conical portion thereof engages flange 13 to provide a self-centering seating action. Shell 12 is then rolled or turned against a suitable tool to deform a portion of the shell to engage undercut 17 about the perimeter thereof. As previously noted, by using a mechanically assembled base, shell 11 may comprise thinner material. However, the work hardening of the metal, resulting from a blank being formed into the base shell, increases the chances of damaging the shell during subsequent reworking and also increases its susceptibility to stress corrosion cracking. Forming the bead against undercut 17 supports the metal with reduced risk of damage to the shell. Thus, undercut 17 provides two functions: locking the insulator in place and supporting the metal during the deformation thereof to engage insulator 15.

Yet another way to fabricate such bases which is widely used in commercial practice at the present time is to form metal shell 11 and contact 16 which are then positioned in the appropriate spatial relationship with respect to each other, with insulation 15 then being formed in-situ from glass, plastic or other suitable material as is known to those skilled in the art.

The foregoing is meant to be illustrative and should not be taken as limiting the present invention in any way.

The invention will be further understood by reference to the Examples below which, although directed to metal screw type lamp bases employing various copper alloys, it is believed produced results analogous to those which would be expected with the metal portions of lamp sockets which make electrical contact with the corresponding metal parts of lamp bases.

EXAMPLES

In the following Examples, an ammonium chloride stress corrosion test which utilizes moist ammonia vapor was employed which comprised a closeable glass vessel, such as a desiccator vessel or simple glass trough with ground rim and lid having a volume generally of at least about 10 liters to maintain a ratio of test space to volume of test solution of about 20:1 to 10:1. The test solution was an alkaline solution of ammonium chloride In the preparation of, for example, 1 liter of ammonium chloride corrosion test solution, 107 g of reagent grade ammonium chloride was dissolved in about 750 ml of distilled or demineralized water to which was added as much of a 30% sodium hydroxide solution, prepared from reagent grade sodium hydroxide and distilled or demineralized water, as was necessary to reach a pH value of 10. In general, this required about 250 ml of 30% NaOH solution at a temperature of 22° C.±1° C.

In conducting a stress corrosion test, specimens to be tested were suspended in such closed vessels over the ammonium chloride solution in a manner such that they did not contact either the test solution or each other. All of the stress-corrosion tests so conducted in the Examples below were done for a time period of 24 hours and at a temperature of 30° C.

EXAMPLE 1

In this example, a number of lamps were made having metal mogul screw bases of the general type disclosed in FIG. 4, fabricated from various commercially available copper alloys wherein said bases had an overall diameter of 39.5 mm (1.55 inches) and an overall length of 42.5 mm (1.66 inches). The bases were screwed onto the lamp bases at an aggravated torque of about 35 inch-pounds. These lamps were placed in ammonium chloride-containing desiccators at 30° C. for 24 hours as indicated above and the results of such tests are set forth in the Table below. In all cases the stress relief occurred at the temperature so indicated for each of the alloys set forth below by placing same in an oven for 5 minutes at the temperature indicated prior to screwing same on to the base of the lamp.

TABLE I

| Test | Lamp Base Alloy and Stress Relief Conditions | No. Tested | No. Failures |
|---|---|---|---|
| 1 | Alloy C260 Control Samples 750° F. Stress Relief | 30 | 30 |
| 2 | Alloy C194, No Stress Relieving | 30 | 0 |
| 3 | Alloy C194, Nickel Plated, No Stress Relieving | 29 | 0 |
| 4 | Alloy C194, Stress Relieved for 5 minutes at 650° F. | 30 | 0 |
| 5 | Alloy C194, Nickel Plated, Stress Relieved for 5 minutes at 650° F. | 30 | 0 |
| 6 | Alloy C194, Stress Relieved for 5 minutes at 750° F. | 30 | 0 |
| 7 | Alloy C194, Nickel Plated, Stress Relieved for 5 minutes at 750° F. | 30 | 0 |
| 8 | Alloy C706, No Stress Relieving | 36 | 0 |
| 9 | Alloy C706, Stress Relieved for 5 minutes at 650° F. | 36 | 0 |
| 10 | Alloy C706, Stress Relieved for 5 minutes at 750° F. | 28 | 0 |

The alloy 260 is a high zinc content cartridge brass type of copper alloy having a nominal composition of 70 wt. % Cu and 30 wt. % Zn. The alloy 194 has a nominal composition of 97.4 wt. % Cu, 2.4 wt % Fe, 0.13 wt. % Zn, and 0.04 wt. % P, and which may also contain Pb in an amount not exceeding about 0.03 wt. %. The alloy 706 has a nominal composition of 88.6 wt. % Cu, 1.4 wt. % Fe, 10 wt. % Ni and, optionally, Pb, Zn and Mn in amounts not exceeding about 0.05, 1.0 and 1.0 wt. %, respectively.

One can see from the stress corrosion results that all of the lamp bases fabricated from the 260 copper alloy failed the test, while those fabricated from the high copper content 194 and 706 alloys all passed the test.

EXAMPLE 2

In this Example, a number of metal halide vapor (MV) and high pressure sodium (HPS) arc discharge lamps made by a lamp manufacturer other than GE were purchased, placed in desiccators for the 24 hour stress corrosion test at 30° C., and then removed from the desiccators and examined for cracks at the rim portion of each base where it contacted the lamp envelope and also for any cracks in or parallel to the screw threads Analysis of the metal lamp bases indicated that the bases had been fabricated from a high zinc content type of cartridge brass copper alloy and probably the 260 alloy referred to in the previous Example. The results are set forth in the Table below.

TABLE II

| Lamp Type | Wattage | Rim Crack | Thread Crack |
|---|---|---|---|
| HPS | 50 | Yes | Yes |
| HPS | 50 | Yes | Yes |
| MV | 175 | Yes | No |
| MV | 175 | No | No |
| MV | 175 | Yes | No |
| MV | 175 | Yes | No |
| MV | 175 | Yes | No |
| MV | 175 | Yes | No |
| MV | 250 | Yes | No |
| MV | 250 | Yes | Yes |
| MV | 400 | Yes | Yes |
| MV | 400 | Yes | Yes |
| MV | 400 | Yes | Yes |
| MV | 400 | Yes | Yes |
| MV | 400 | Yes | Yes |

What is claimed is:

1. A socket for an electric lamp wherein said socket comprises a housing or base of electrically insulative material containing at least one cavity for receiving a metal base portion of said lamp wherein said cavity has a metal portion within which makes electrical contact with a corresponding or mating metal portion of said metal base portion of said lamp and which is fabricated from a high copper content copper alloy comprising copper in an amount of at least about 94 wt. % along with at least one other metal selected from the group consisting essentially of Cd, Zn, Fe, P, Zr, Sn, Co, Si, Al, Cr and mixture thereof.

2. The socket of claim 1 wherein said alloy comprises at least about 96 wt. % Cu along with at least two other metals selected from the group consisting essentially of Fe, P, Sn and mixture thereof.

3. The socket of claim 1 wherein said alloy consists essentially of Cu and Cd with the aggregate amount of Cu and Cd present in an amount of at least about 99.90 wt. % and with the amount of Cd present ranging between about 0.05–0.30 wt. %.

4. The socket of claim 1 wherein said copper alloy comprises at least about 97.0 wt. % Cu along with minor amounts of Zn, Fe and P.

5. The socket of claim 4 wherein the amount of Zn, Fe and P present in said alloy ranges between about 0.05–0.20 wt. %, 2.1–2.4 wt. % and 0.015–0.15 wt. %, respectively.

6. The socket of claim 5 wherein said alloy also contains Pb in an amount not exceeding about 0.03 wt. %.

7. A socket for an electric lamp wherein said socket comprises a housing or base of electrically insulative material containing at least one cavity for receiving a metal base portion of said lamp wherein said cavity has a metal portion within which makes electrical contact with a corresponding or mating metal portion of said metal base portion of said lamp and which is fabricated from a relatively high nickel content copper alloy comprising copper in an amount of at least about 85 wt. % along with at least about 8.5 wt. % Ni and a metal selected from the group consisting essentially of Fe and Sn.

8. The socket of claim 7 wherein said metal selected from the group consisting essentially of Fe and Sn is present in said alloy in an amount of less than about 3 wt. %.

9. The socket of claim 7 wherein said relatively high nickel content copper alloy comprises at least about 85 wt. % Cu, at least about 9.0 wt % Ni and Fe, wherein the amount of Fe present in said alloy ranges between about 1.0–1.5 wt. %.

10. The socket of claim 9 wherein said alloy also contains one or more additional alloying metals selected from the group consisting essentially of Pb, Zn, Mn, and mixture thereof.

11. The socket of claim 10 wherein said additional alloying metal or metals is present in said alloy in an aggregate amount not exceeding about 2.5 wt. %.

12. A socket for an electric lamp wherein said socket comprises a housing or base of electrically insulative material containing at least one cavity for receiving a metal base portion of said lamp wherein said cavity has a metal portion within which makes electrical contact with a corresponding or mating metal portion of said metal base portion of said lamp and which is fabricated from a relatively high nickel content copper alloy comprising copper in an amount of at least about 60 wt. %, nickel in an amount of at least 8 wt. % and zinc in an amount of less than about 10 wt. %.

* * * * *